US012196055B2

(12) United States Patent
Vasques

(10) Patent No.: US 12,196,055 B2
(45) Date of Patent: Jan. 14, 2025

(54) DOWNHOLE EXPANDABLE METAL TUBULAR

(71) Applicant: Welltec Manufacturing Center Completions ApS, Esbjerg N (DK)

(72) Inventor: Ricardo Reves Vasques, Zug (CH)

(73) Assignee: Welltec Manufacturing Center Completions ApS, Esbjerg N (DK)

( * ) Notice: Subject to any disclaimer, the term of this patent is extended or adjusted under 35 U.S.C. 154(b) by 0 days.

(21) Appl. No.: 18/094,018

(22) Filed: Jan. 6, 2023

(65) Prior Publication Data

US 2023/0220743 A1 Jul. 13, 2023

(30) Foreign Application Priority Data

Jan. 7, 2022 (EP) ..... 22150627
Feb. 4, 2022 (EP) ..... 22155204

(51) Int. Cl.
*E21B 43/10* (2006.01)
*E21B 33/12* (2006.01)
*E21B 33/124* (2006.01)

(52) U.S. Cl.
CPC ..... *E21B 33/1243* (2013.01); *E21B 33/1208* (2013.01); *E21B 43/10* (2013.01); *E21B 43/103* (2013.01)

(58) Field of Classification Search
CPC .... E21B 17/1078; E21B 23/03; E21B 43/128; E21B 33/12; E21B 33/127; E21B 43/10;
(Continued)

(56) References Cited

U.S. PATENT DOCUMENTS 11,377,934 B1 7/2022 Pirayeh Gar et al.
2007/0267824 A1 11/2007 Baugh et al.

FOREIGN PATENT DOCUMENTS

EP 3 106 606 12/2016
GB 2 404 677 2/2005
(Continued)

OTHER PUBLICATIONS

International Search Report mailed Mar. 20, 2023 in International Application No. PCT/EP2023/050244, 14 pages.
(Continued)

*Primary Examiner* — Yong-Suk (Philip) Ro
(74) *Attorney, Agent, or Firm* — Nixon & Vanderhye P.C.

(57) ABSTRACT

The present invention relates to a downhole expandable metal tubular to be expanded in a well from a first outer diameter to a second outer diameter to abut against an inner face of a casing or borehole, the downhole expandable metal tubular having an axial extension, a circumference and an outer face, wherein the downhole expandable metal tubular is of metal with at least one first integral circumferential sealing element of metal as part of the outer face, providing the downhole expandable metal tubular with a first circumferential projection having a fourth height, and the at least one first integral circumferential sealing element at least partly defines a cavity having an opening. Moreover, the present invention also relates to a downhole expandable metal tubular assembly further comprising at least one end tubular, a patch for being expanded within a well tubular metal structure for sealing off leaks, perforations or apertures in the well tubular metal structure, and an annular barrier to be expanded in an annulus between a well tubular structure and an inner face of a borehole or a casing downhole for providing zone isolation between a first zone and a second zone of the borehole.

17 Claims, 5 Drawing Sheets

Figure 1:
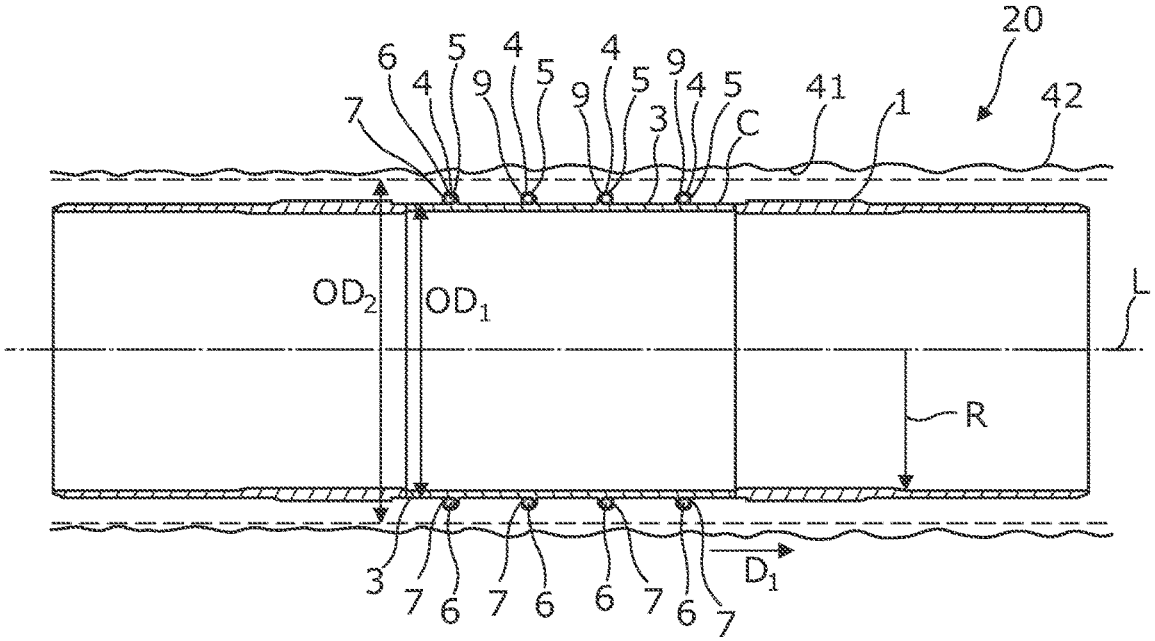

(58) Field of Classification Search
CPC ..... E21B 43/103; E21B 33/1212; E21B 33/1277; E21B 33/1243; E21B 33/1208
See application file for complete search history.

(56) References Cited

FOREIGN PATENT DOCUMENTS

| | | | |
|---|---|---|---|
| GB | 2 577 566 | A | 4/2020 |
| WO | 02/059452 | | 8/2002 |
| WO | WO 2009/061768 | A2 | 5/2009 |

OTHER PUBLICATIONS

Extended Search Report for EP22155204.5, dated Jul. 1, 2022, 9 pages.

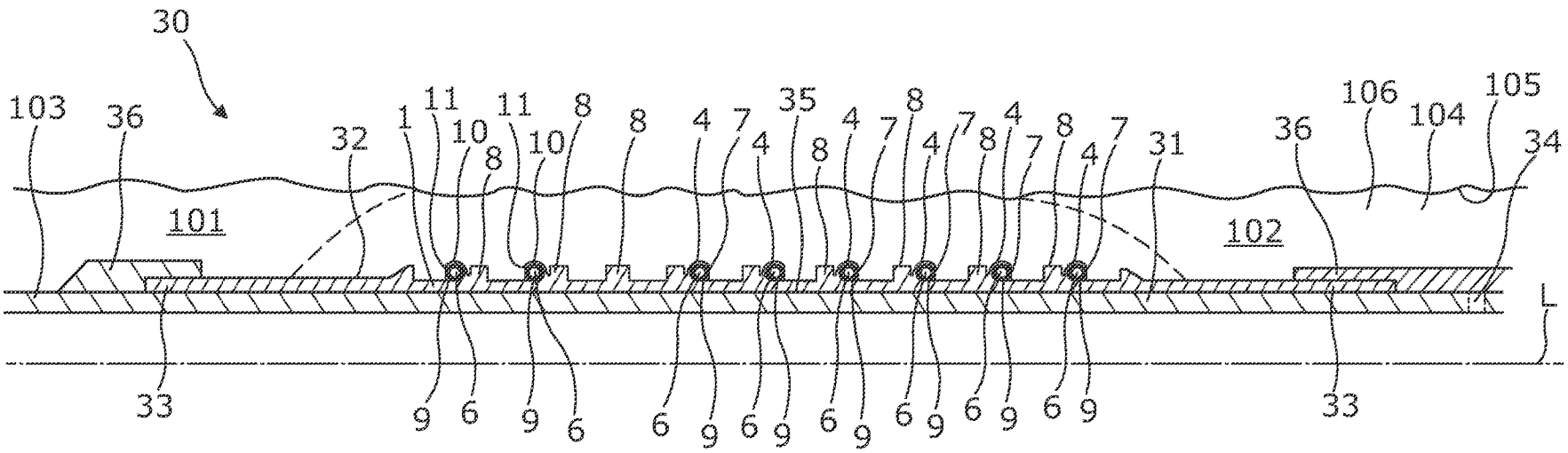
30
103
36
101
32
1
11
10
8
11
10
8
8
8
4
7
4
35
8
4
7
8
4
7
8
4
7

DOWNHOLE EXPANDABLE METAL TUBULAR

This application claims priority to EP patent application Ser. No. 22/150,627.2 filed Jan. 7, 2022, and EP patent application Ser. No. 22/155,204.5 filed Feb. 4, 2022, the entire contents of each of which are hereby incorporated by reference.

The present invention relates to a downhole expandable metal tubular to be expanded in a well downhole. Furthermore, the present invention relates to a patch and an annular barrier.

In wellbores, expandable metal tubulars are used for different purposes, such as for sealing off an opening in the casing, in the form of a patch or liner, for providing a barrier to flow between an inner and an outer tubular structure, or between an inner tubular structure and the inner wall of the borehole, in the form of an annular barrier, or for providing a liner hanger.

When the expandable metal tubulars are being used to seal off e.g. an opening or a zone, separate sealing elements are often provided on an exterior face of the expandable metal tubular for enhancing the sealing properties. Conventional sealing elements are made of polymers and elastomeric materials which have shown to have insufficient sealing ability in high-temperature wells, such as geothermal wells, and therefore the sealing elements have been developed to be made of PTFE; however, PTFE has proven insufficient for sealing elements, as PTFE does not seem to have sufficient flexibility in high-temperature wells.

It is an object of the present invention to wholly or partly overcome the above disadvantages and drawbacks of the prior art. More specifically, it is an object to provide a downhole expandable metal tubular with enhanced sealing properties in wells having high temperatures above 300° C.

The above objects, together with numerous other objects, advantages and features, which will become evident from the below description, are accomplished by a solution in accordance with the present invention by a downhole expandable metal tubular to be expanded in a well from a first outer diameter to a second outer diameter to abut against an inner face of a casing or borehole, the downhole expandable metal tubular having an axial extension, a circumference and an outer face, wherein the downhole expandable metal tubular is of metal with at least one first integral circumferential sealing element of metal as part of the outer face, providing the downhole expandable metal tubular with a first circumferential projection having a fourth height, and the at least one first integral circumferential sealing element at least partly defines a cavity having an opening.

By having a downhole expandable metal tubular with sealing elements only of metal material, the downhole expandable metal tubular can be used in high-temperature wells, in geothermal wells and in Carbon Capture Storage (CCS) applications. By having a downhole expandable metal tubular without any elements of material other than metal materials, the downhole expandable metal tubular is not limited to temperatures substantially below 300° C.

Moreover, the at least one integral circumferential sealing element of metal may form one monolitic whole with the downhole expandable metal tubular.

Further, the downhole expandable metal tubular may also comprise a resilient element of metal arranged in the cavity.

By having a resilient element of metal arranged in the cavity, the sealing elements are only of metal material and are also flexible and able to be compressed during expansion and after decompression fill up the small gap occurring during relaxing of the metal when the pressure is decreased. Thus, by having a flexible sealing element and a resilient element, the downhole expandable metal tubular can be used in all wells and especially in high-temperature wells, in geothermal wells and in Carbon Capture Storage (CCS) applications.

Furthermore, the cavity and the opening may extend along at least part of the entire circumference.

In addition, the opening may face a first axial direction parallel to the axial extension.

Also, the cavity may be closed in a radial direction perpendicular to the axial extension.

Further, in a cross-sectional view of the downhole expandable metal tubular along the axial extension, the opening may have a first height in a radial direction perpendicular to the axial extension, and the cavity may have a second height in a radial direction perpendicular to the axial extension, the first height being smaller than the second height.

Moreover, in a cross-sectional view of the downhole expandable metal tubular along the axial extension, the at least one first integral circumferential sealing element may have the fourth height in a radial direction perpendicular to the axial extension, the opening may have a first height in the radial direction, and the first height being smaller than the fourth height.

Additionally, in a cross-sectional view of the downhole expandable metal tubular along the axial extension, the integral circumferential sealing element may have a C-shape, U-shape or similar shape.

Moreover, the downhole expandable metal tubular may further comprise a spacing element having a third height being smaller than a fourth height of the at least one first integral circumferential sealing element.

The spacing element prevents the sealing element from being squeezed too much for it to function properly and thus prevents it from permanently deforming. In this way, the spacing element ensures that the flexibility of the sealing element and the resilient element is maintained intact during expansion of the downhole expandable metal tubular.

In addition, the third height may be smaller than the second height.

Furthermore, the spacing element may be part of the at least one first integral circumferential sealing element or may be arranged distally from the at least one first integral circumferential sealing element along the axial extension.

The downhole expandable metal tubular may further comprise a resilient element arranged in the cavity.

Also, the first circumferential projection may have a distal free end and a proximal end connected to the downhole expandable metal tubular, where the circumferential projection may have a contact surface for contacting the casing and/or the borehole, where the contact surface is arranged proximal to the distal end and distal to the proximal end.

Thus, the contact surface may be arranged in between the distal end and the proximal end.

In addition, the contact surface may be arranged away from the distal end, and the contact surface may be arranged closer to the distal end than the proximal end.

By having the contact surface between the distal end and the proximal end, or away from the distal end, the compression force during expansion acts at a more flexible part of the circumferential projection, ensuring that the bending occurs in the intended way so that the circumferential projection provides the intended flex back in order to maintain contact with the wall of the borehole or the well tubular metal structure. Thus, by having the contact surface between the distal end and the proximal end, or away from the distal end, the circumferential projection, after decompression, fills up the small gap occurring during relaxing of the metal when the pressure is decreased, and unintended plastic deformation is avoided.

Furthermore, the first circumferential projection may be configured to resiliently deform in only a part of the first circumferential projection.

Additionally, the spacing element may have a higher Young's Modulus than that of the at least one first integral circumferential sealing element and/or the resilient element.

Also, the spacing element may be arranged in a first axial distance from the at least one first integral circumferential sealing element, the first axial distance being equal to or larger than an axial extension of the resilient element.

Further, the spacing element may be arranged in a position facing away from the opening.

The downhole expandable metal tubular may further comprise a resilient element arranged in the cavity, the resilient element having a fifth height being larger than the first height.

Furthermore, the resilient element may be made of metal.

By having a downhole expandable metal tubular of metal with an integral circumferential sealing element of metal and a resilient element made of metal, the sealing element is made entirely of metal and comprises no other materials than metal and is therefore able to withstand very high temperatures, such as above 350° C. (Celsius).

In addition, the downhole expandable metal tubular may be made completely of metal material.

Being made fully of metal material, the downhole expandable metal tubular can be used in high-temperature wells, in geothermal wells and in Carbon Capture Storage (CCS) applications. By having a downhole expandable metal tubular without any elements of material other than metal materials, the downhole expandable metal tubular is not limited to temperatures substantially below 300° C.

Additionally, the material of the resilient element may have a lower Young's Modulus than that of the material of the sealing element.

Furthermore, the resilient element may be a coiled spring. The resilient element may be a circumferential resilient element extending along the circumference of the outer face of the downhole expandable metal tubular.

Also, the integral circumferential sealing element may comprise a projecting flange extending in a radial direction perpendicularly to the axial extension and having a curvature.

By having a projecting flange having a curvature, the integral circumferential sealing element can easily be compressed when the downhole expandable metal tubular is expanded, and the projecting flange is not bulged in an unintended way so that the projecting flange cannot flex back once the compression is released.

Further, the integral circumferential sealing element may comprise a projecting flange forming the cavity.

By having a projecting flange forming the cavity, the projecting flange forms a curvature, and in this way the projecting flange is not bulged in an unintended way during compression of the downhole expandable metal tubular so that the projecting flange cannot flex back once the compression is released.

When having a projecting flange extending in a straight line, there is a risk that the projecting flange will bulge in an unintended way and get stuck during compression of the downhole expandable metal tubular so that the projecting flange cannot flex back once the compression is released.

Also, the first circumferential projection may have a third outer diameter, where the third outer diameter is larger than the first outer diameter of the expandable metal tubular. In this embodiment, the first outer diameter may be seen as the maximal outer diameter of the downhole expandable metal tubular in an area that is void of at least one integral circumferential sealing element and/or a spacing element. Thus, the outermost part of the expandable metal tubular prior to expansion may be the first circumferential projection.

Furthermore, the first circumferential projection may have a third outer diameter that extends in a radial direction beyond the first outer diameter prior to expansion of the downhole expandable metal tubular.

Moreover, the projecting flange forming the cavity may overlap at least one resilient element along the axial extension.

In addition, the downhole expandable metal tubular may further comprise a second integral circumferential sealing element of metal as part of the outer face, the second integral circumferential sealing element having an opening facing a second axial direction along the axial extension, the second axial direction being opposite the first axial direction.

Also, the second integral circumferential sealing element may comprise a resilient element.

Furthermore, the resilient element may provide a resilient force to the circumferential projection in a radial direction away from the axial extension of the expandable metal tubular. Thus, the resilient force may be provided in a radial direction away from the outer face of the expandable metal tubular. This means that the resilient element may provide a force that pushes the circumferential projection in a radial direction away from the outer face, and in a direction towards the inner face of the casing or the borehole.

Moreover, the resilient element may have an outer volume that is smaller than an inner volume of the cavity.

Also, the inner volume of the cavity may hold the entire outer volume of the resilient element.

Moreover, the first circumferential projection may extend in a curved trajectory from an outer face of the downhole expandable metal tubular, or the first circumferential projection may extend in an arc-formed trajectory from an outer face of the downhole expandable metal tubular, or the first circumferential projection may extend in an arch-formed trajectory from an outer face of the downhole expandable metal tubular, seen in a cross-sectional view taken along the longitudinal axis.

Furthermore, the first circumferential projection may have a central axis having a first axis length extending along the length of the circumferential projection, where the angle of the central axis relative to an outer face of the expandable downhole tubular may change along the first axis length of the central axis. As an example, the central axis may be arranged at an angle relative to the outer face at a first degree (example: 90 degrees±20 degrees) at the part of the circumferential projection that is closest to the outer face (first radial distance), while the angle changes to a second degree in an area of the circumferential projection that is at a second radial distance from the outer face, where the second radial distance is larger than the first radial distance.

Also, the first circumferential projection may have a central axis having a first axis length extending along the length of the circumferential projection, where the angle of the central axis relative to an outer face of the expandable downhole tubular may change by at least 20 degrees along the first axis length of the central axis, or more preferably may change by at least 40 degrees, or more preferably may change by at least 70 degrees, or more preferably may change by at least 90 degrees. Thus, the one part of the projection may be arranged at an angle of about 90 degrees, where another part of the projection may be arranged at an angle of about 70 degrees, or 50 degrees, or 0 degrees.

Further, the integral circumferential sealing element may comprise at least two resilient elements.

The present invention also relates to a downhole expandable metal tubular assembly comprising a plurality of downhole expandable metal tubulars, wherein one of the downhole expandable metal tubulars is joined to another of the downhole expandable metal tubulars.

According to the present invention, the expandable metal tubular assembly may also be joined by welding.

Furthermore, the expandable metal tubular assembly may be joined by electron beam welding.

Additionally, the downhole expandable metal tubular assembly may further comprise at least one end tubular, wherein the end tubular is configured to expand at a higher pressure than the downhole expandable metal tubulars.

The present invention also relates to a patch for being expanded within a well tubular metal structure for sealing off leaks, perforations or apertures in the well tubular metal structure, wherein the patch is the downhole expandable metal tubular or the downhole expandable metal tubular assembly.

Finally, the present invention also relates to an annular barrier to be expanded in an annulus between a well tubular structure and an inner face of a borehole or a casing downhole for providing zone isolation between a first zone and a second zone of the borehole, comprising:

- a tubular metal part for mounting as part of the well tubular metal structure,
- a downhole expandable metal tubular or a downhole expandable metal tubular assembly surrounding the tubular metal part and having an outer tubular face facing towards an inner face of the borehole or the casing, each end of the downhole expandable metal tubular/the downhole expandable metal tubular assembly being connected with the tubular metal part, and
- an expansion space between the downhole expandable metal tubular/the downhole expandable metal tubular assembly and the tubular metal part.

Figure 2:
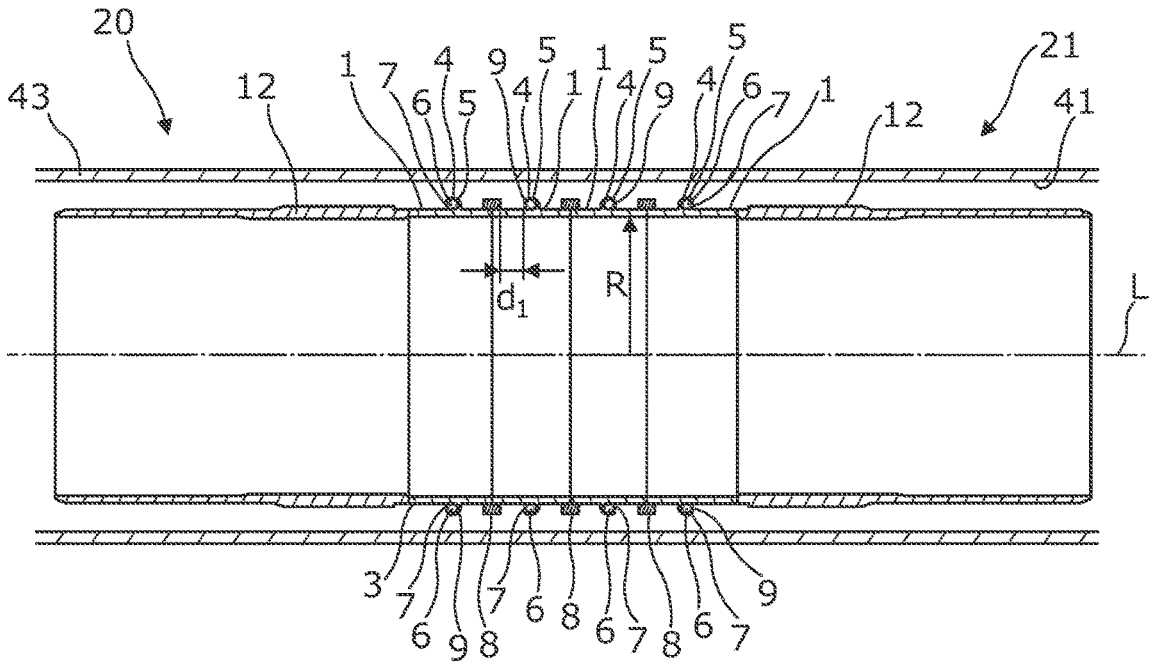
Figure 3:
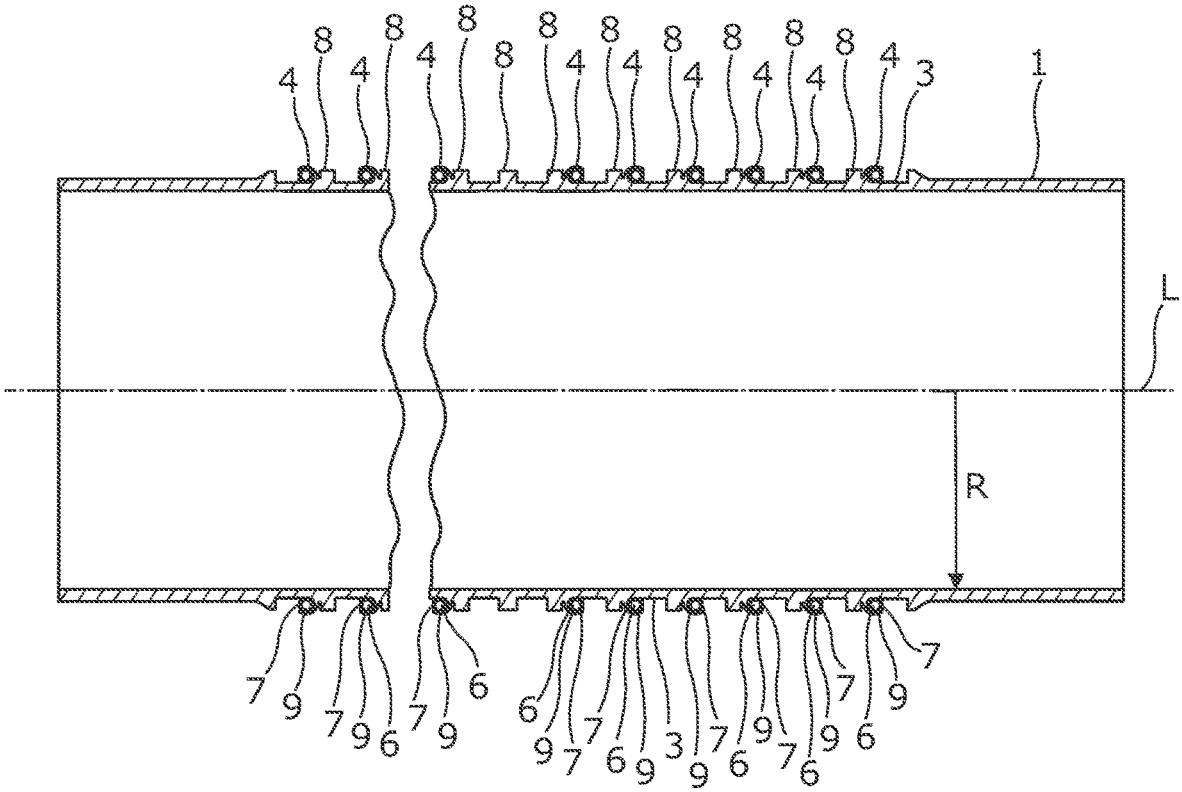
Figure 4:
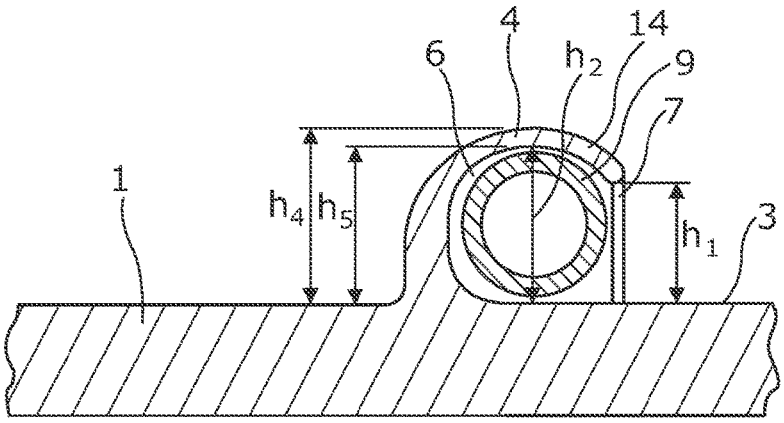
Figure 5:
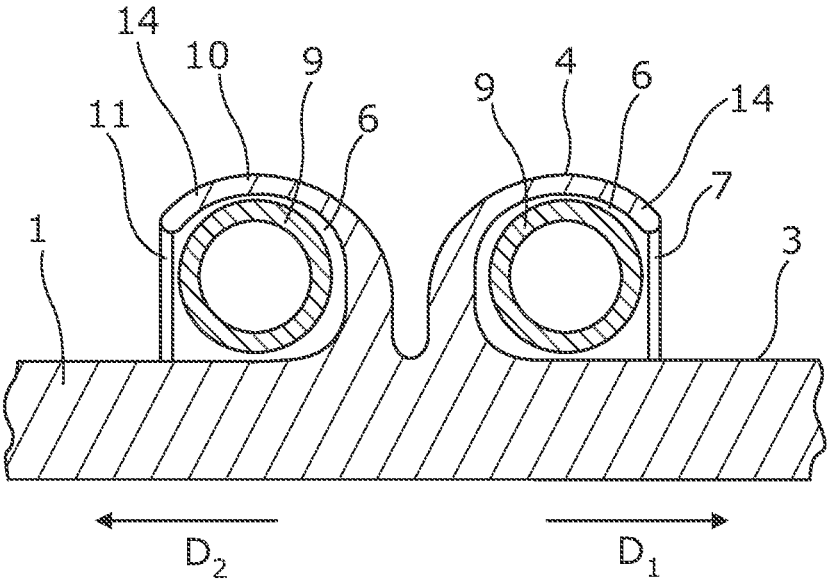
Figure 6:
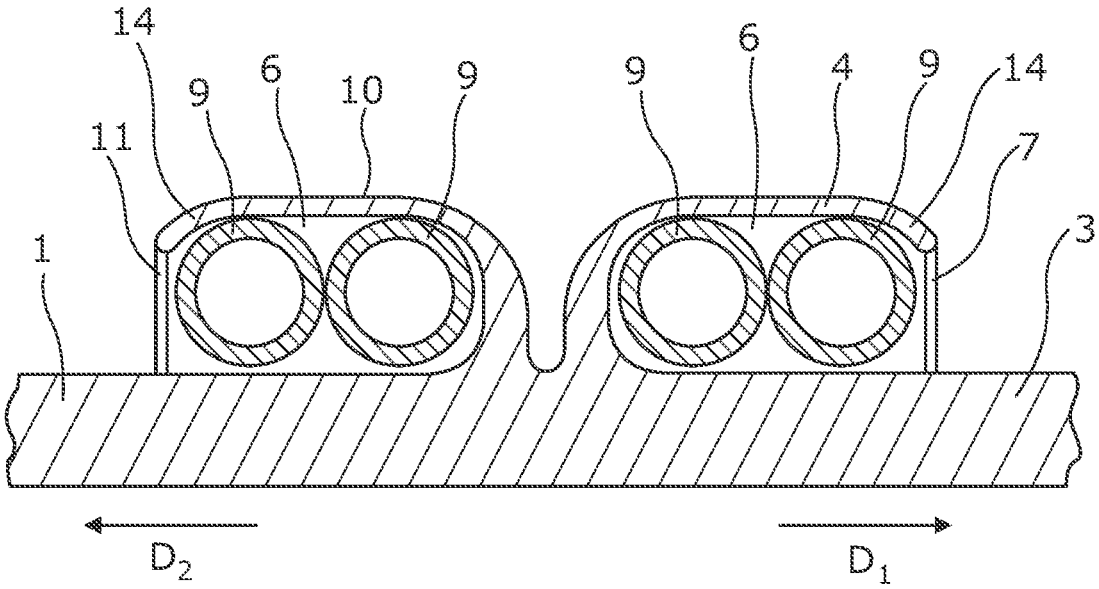
Figure 7:
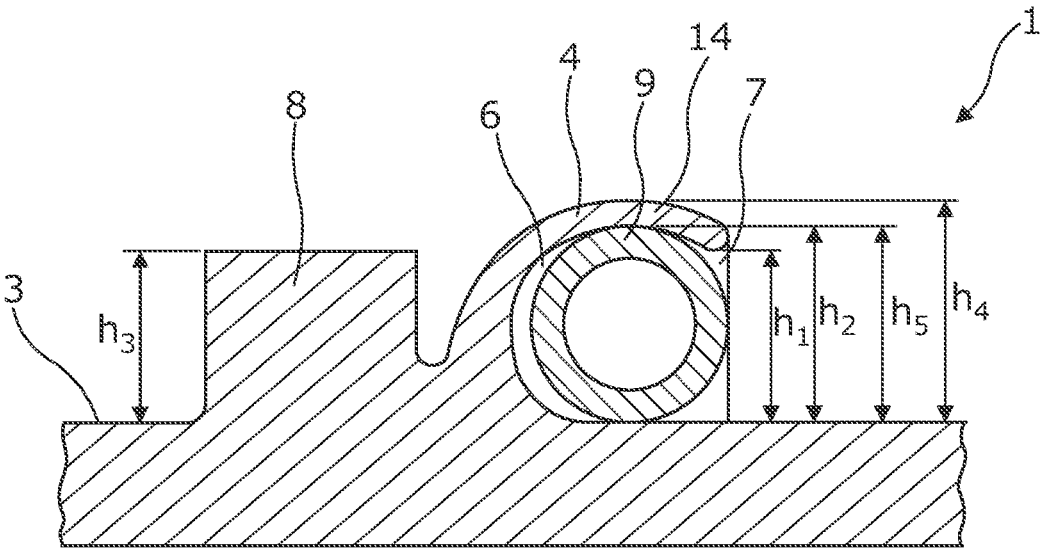
Figure 8:
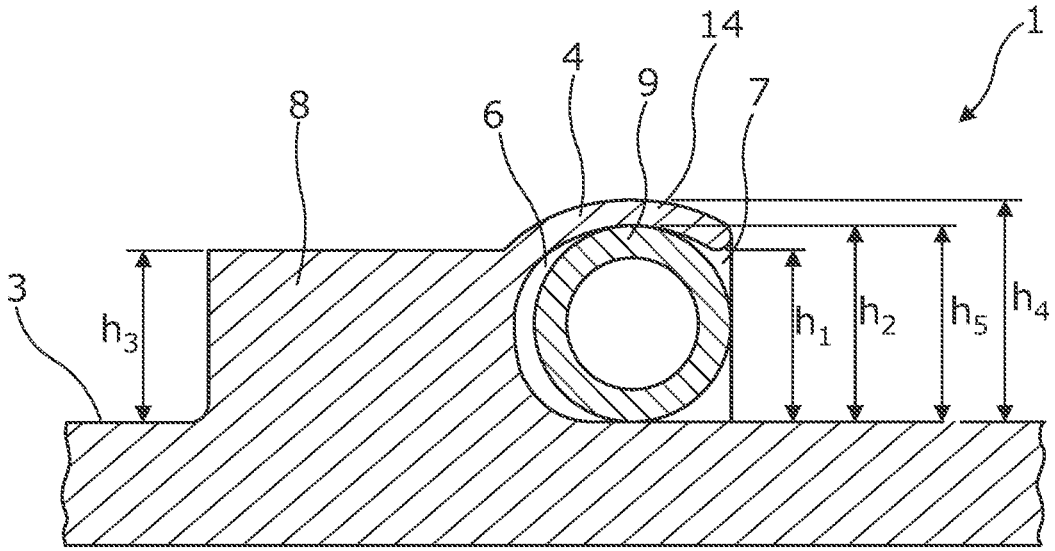

The invention and its many advantages will be described in more detail below with reference to the accompanying schematic drawings, which for the purpose of illustration show some non-limiting embodiments and in which:

FIG. 1 is a cross-sectional view of a downhole expandable metal tubular,

FIG. 2 is a cross-sectional view of a downhole expandable metal tubular assembly, FIG. 3 is a cross-sectional view of another downhole expandable metal tubular, FIG. 4 is a cross-sectional view of a part of a downhole expandable metal tubular with an integral circumferential sealing element, FIG. 5 is a cross-sectional view of a part of a downhole expandable metal tubular with a first integral circumferential sealing element and a second integral circumferential sealing element, FIG. 6 is a cross-sectional view of a part of a downhole expandable metal tubular with another first integral circumferential sealing element and another second integral circumferential sealing element, FIG. 7 is a cross-sectional view of a part of a downhole expandable metal tubular with another integral circumferential sealing element, FIG. 8 is a cross-sectional view of a part of a downhole expandable metal tubular with another integral circumferential sealing element, and FIG. 9 is a cross-sectional view of an annular barrier.

All the figures are highly schematic and not necessarily to scale, and they show only those parts which are necessary in order to elucidate the invention, other parts being omitted or merely suggested.

FIG. 1 shows a downhole expandable metal tubular 1 to be expanded in a well from a first outer diameter $OD_1$ to a second outer diameter $OD_2$ to abut against an inner face 41 of a casing 43 (shown in FIG. 2) or a borehole 42. The expanded condition of the downhole expandable metal tubular 1 is indicated by a dotted line. The downhole expandable metal tubular 1 has an axial extension L, a circumference C and an outer face 3. The downhole expandable metal tubular 1 may form a patch 20 to be expanded within the casing 43 or a well tubular structure in a well. The downhole expandable metal tubular 1 may also be a liner hanger 21 to be at least partly expanded within the casing 43 or a well tubular structure in the well. The downhole expandable metal tubular 1 may also form part of an annular barrier 30 (shown in FIG. 9) to be expanded in an annulus 104 between a well tubular structure and an inner face 105 of a borehole 106 or the casing 43 downhole for providing zone isolation between a first zone 101 and a second zone 102 of the borehole.

The downhole expandable metal tubular 1 is of metal with at least one first integral circumferential sealing element 4 of metal as part of the outer face 3, so that the first integral circumferential sealing element 4 provides a first circumferential projection 5 of the downhole expandable metal tubular 1. The integral circumferential sealing element 4 at least partly defines a cavity 6 having an opening 7. The at least one first integral circumferential sealing element 4 of metal forms one monolitic whole with the downhole expandable metal tubular 1. The cavity 6 and the opening 7 extend along at least part of the entire circumference C. The opening 7 faces a first axial direction $D_1$ that is parallel to the axial extension L. The cavity 6 is closed in a radial direction R perpendicular to the axial extension L.

The downhole expandable metal tubular 1 further comprises a plurality of resilient elements 9 of metal, where one resilient element 9 is arranged in the cavity 6 of the integral circumferential sealing element 4 as shown in FIGS. 1 and 2. When seen in a cross-sectional view of the downhole expandable metal tubular 1 along the axial extension L in FIGS. 1, 2 and 4, the integral circumferential sealing element 4 has a C-shape, but in another embodiment the integral circumferential sealing element has a U-shape or a similar shape able to maintain the resilient element in the cavity 6.

By having a downhole expandable metal tubular 1 of metal with an integral circumferential sealing element 4 of metal and a resilient element 9 made of metal, the sealing element is made fully of metal and comprises no other materials than metal, and the sealing element is therefore able to withstand very high temperatures, such as above 350° C. By having a downhole expandable metal tubular 1 made fully of metal material, the downhole expandable metal tubular 1 can be used in high-temperature wells, in geothermal wells and in Carbon Capture Storage (CCS) applications. By having a downhole expandable metal tubular 1 without any elements of material other than metal materials, the downhole expandable metal tubular is not limited to temperatures substantially below 300° C.

As shown, the integral circumferential sealing element 4 comprises a projecting flange 14 forming the cavity 6. The projecting flange 14 forms the cavity 6 and overlaps at least one resilient element 9 along the axial extension L.

In FIG. 2, the downhole expandable metal tubular 1 further comprises a spacing element 8 arranged between two integral circumferential sealing elements 4. The spacing element 8 is arranged in a first axial distance $d_1$ from the sealing element 4 along the axial extension L, the first axial distance being equal to or larger than the axial extension of the resilient element 9. As a result of the first axial distance $d_1$ being equal to or larger than the axial extension L of the resilient element 9, the resilient element can be mounted in the cavity 6 after the downhole expandable metal tubular 1 is treated by e.g. annealing. If the resilient element 9 was already in the cavity 6 during such annealing process, the resilient element would lose some of its flexibility. The C-shape of the sealing element 4 may be made after inserting the resilient element 9 in the cavity 6 by bending the "end of the C", i.e. the projecting part ending in the opening. As shown in FIG. 8, the spacing element 8 may be part of the sealing element 4 or, as shown in FIGS. 2, 3 and 8, arranged distally from the sealing element along the axial extension L. The spacing element 8 has a higher Young's Modulus than that of the sealing element 4 and/or the resilient element 9. FIG. 2 shows a downhole expandable metal tubular assembly 20 comprising a plurality of downhole expandable metal tubulars 1, where one of the downhole expandable metal tubulars 1 is joined to another of the downhole expandable metal tubulars 1. The downhole expandable metal tubulars 1 are joined by welding, e.g. electron beam welding. The spacing element 8 may be added also by means of welding by adding further material on the weld seam. The downhole expandable metal tubular 1 further comprises an end tubular 12 in each end, and the end tubulars are configured to expand at a higher pressure than the downhole expandable metal tubulars 1. FIG. 3 shows the downhole expandable metal tubular 1 with the spacing elements 8 and the sealing elements 4 formed as one monolithic whole.

In the cross-sectional view of part of the downhole expandable metal tubular 1 along the axial extension L of FIG. 4, the opening 7 has a first height $h_1$ in the radial direction R (shown in FIG. 1) perpendicular to the axial extension L, and the cavity 6 has a second height $h_2$ in the radial direction R perpendicular to the axial extension, where the first height is smaller than the second height.

As shown in FIG. 4, the downhole expandable metal tubular 1 further comprises the resilient element 9 arranged in the cavity 6. When the downhole expandable metal tubular 1 is expanded, and the integral circumferential sealing element 4 is pressed against the inner face of the borehole or the casing, the resilient element 9 is compressed. Subsequently, when the expansion is over and the pressure is decreased, the downhole expandable metal tubular 1 flexes somewhat backwards and radially inwards, the compression of the resilient element 9 is released and presses the sealing element 4 radially outwards, taking up the small gap occurring during the somewhat backwards movement of the downhole expandable metal tubular. The resilient element 9 has a fifth height $h_5$ being larger than the first height $h_1$. The resilient element 9 is made of metal, and the resilient element may be a coiled spring. The material of the resilient element 9 has a lower Young's Modulus than that of the material of the sealing element 4. As can be seen in FIG. 4, the resilient element 9 has an outer volume that is smaller than an inner volume of the cavity 6.

In FIG. 7, the spacing element 8 has a third height $h_3$ being smaller than a fourth height $h_4$, so that when the downhole expandable metal tubular 1 is expanded and the integral circumferential sealing element 4 is pressed against the inner face of the borehole or a casing, the spacing element 8 prevents the sealing element from being squeezed too much and prevents it from permanently deforming. In this way, the spacing element 8 ensures that the flexibility of the sealing element 4 and the resilient element 9 is maintained intact during expansion of the downhole expandable metal tubular 1. As shown, the third height $h_3$ may also be smaller than the second height $h_2$. In FIGS. 7 and 8, the spacing element 8 is arranged in a position facing away from the opening 7.

In FIGS. 5 and 6, the downhole expandable metal tubular 1 further comprises a second integral circumferential sealing element 10 of metal as part of the outer face. The second integral circumferential sealing element 10 has an opening 11 facing a second axial direction $D_2$ along the axial extension L, the second axial direction being opposite the first axial direction $D_1$. The second integral circumferential sealing element 10 comprises, in the same way as the first integral circumferential sealing element 4, the cavity 6 and the opening 11 as well as the resilient element 9 arranged in the cavity. In FIG. 6, the integral circumferential sealing elements 4, 10 comprise at least two resilient elements 9 in order to further strengthen the sealing ability of the sealing elements 4, 10.

FIG. 9 discloses an annular barrier 30 to be expanded in an annulus between a well tubular structure and an inner face of the borehole 106 or the casing downhole for providing zone isolation between the first zone 101 and the second zone 102 of the borehole. The annular barrier 30 comprises a tubular metal part 31 mounted as part of a well tubular metal structure 103. The annular barrier 30 further comprises the downhole expandable metal tubular 1 or the downhole expandable metal tubular assembly 20 surrounding the tubular metal part 31 and having an outer tubular face 32 facing towards the inner face 105 of the borehole 106 or the casing. Each end 33 of the downhole expandable metal tubular 1/the downhole expandable metal tubular assembly 20 being connected with the tubular metal part 31 by a connection part 36 and a valve assembly may be attached to one of the connection parts. An expansion/expandable space 35 is formed between the downhole expandable metal tubular 1/the downhole expandable metal tubular assembly 20 and the tubular metal part 31. In FIG. 9, the annular barrier 30 is shown in its unexpanded condition, and the expanded condition is illustrated by a dotted line and occurs when the well tubular metal structure 103 is pressurised from within, and fluid enters through an aperture 34 in the tubular metal part 31 into the valve assembly and further into the expandable space 35.

By "fluid" or "well fluid" is meant any kind of fluid that may be present in oil or gas wells downhole, such as natural gas, oil, oil mud, crude oil, water, etc. By "gas" is meant any kind of gas composition present in a well, completion or open hole, and by "oil" is meant any kind of oil composition, such as crude oil, an oil-containing fluid, etc. Gas, oil and water fluids may thus all comprise other elements or substances than gas, oil and/or water, respectively.

By "casing", "well tubular structure" or "well tubular metal structure" is meant any kind of pipe, tubing, tubular, liner, string, etc., used downhole in relation to oil or natural gas production.

Although the invention has been described above in connection with preferred embodiments of the invention, it will be evident to a person skilled in the art that several modifications are conceivable without departing from the invention as defined by the following claims.

The invention claimed is:

1. A downhole expandable metal tubular to be expanded in a well from a first outer diameter to a second outer diameter to abut against an inner face of a casing or borehole, the downhole expandable metal tubular having an axial extension, a circumference and an outer face, wherein the downhole expandable metal tubular is of metal with at least one first integral circumferential sealing element of metal as part of the outer face, providing the downhole expandable metal tubular with a first circumferential projection having a projection height in a radial direction perpendicular to the axial extension, and the at least one first integral circumferential sealing element at least partly defines a cavity having an opening, wherein the opening has an opening height in a radial direction perpendicular to the axial extension, and wherein the projection height is higher than the opening height.

2. The downhole expandable metal tubular according to claim 1, further comprising a resilient element of metal arranged in the cavity.

3. The downhole expandable metal tubular according to claim 1, wherein the cavity and the opening extend along at least part of an entire circumference.

4. The downhole expandable metal tubular according to claim 1, wherein the opening faces a first axial direction parallel to the axial extension.

5. The downhole expandable metal tubular according to claim 1, wherein, in a cross-sectional view of the downhole expandable metal tubular along the axial extension, and the cavity has a cavity height in a radial direction perpendicular to the axial extension, the opening height being smaller than the cavity height.

6. The downhole expandable metal tubular according to claim 1, further comprising a spacing element being configured to prevent permanent deforming of the sealing element, said spacing element having a spacing element height being smaller than the projection height of the at least one first integral circumferential sealing element.

7. The downhole expandable metal tubular according to claim 6, wherein the spacing element forms part of the at least one first integral circumferential sealing element, or is arranged distally from the at least one first integral circumferential sealing element along the axial extension.

8. The downhole expandable metal tubular according to claim 6, wherein the spacing element has a higher Young's Modulus than that of the at least one first integral circumferential sealing element and/or the resilient element.

9. The downhole expandable metal tubular according to claim 6, wherein the spacing element is arranged in a first axial distance from the at least one first integral circumferential sealing element, the first axial distance being equal to or larger than an axial extension of the resilient element.

10. The downhole expandable metal tubular according to claim 1, further comprising a resilient element arranged in the cavity, the resilient element having a resilient element height being larger than the opening height.

11. The downhole expandable metal tubular according to claim 1, further comprising a second integral circumferential sealing element of metal as part of the outer face, the second integral circumferential sealing element having an opening facing a second axial direction along the axial extension, the second axial direction being opposite the first axial direction.

12. A downhole expandable metal tubular assembly comprising a plurality of downhole expandable metal tubulars according to claim 1, wherein one of the downhole expandable metal is joined to another of the downhole expandable metal tubulars.

13. The downhole expandable metal tubular assembly according to claim 12, further comprising at least one downhole expandable end tubular, wherein the downhole expandable end tubular is configured to expand at a higher pressure than the downhole expandable metal tubulars.

14. A patch for being expanded within a well tubular metal structure for sealing off leaks, perforations or apertures in the well tubular metal structure, wherein the patch is the downhole expandable metal tubular according to claim 1 or the downhole expandable metal tubular assembly of claim 12.

15. An annular barrier to be expanded in an annulus between a well tubular structure and an inner face of a borehole or a casing downhole for providing zone isolation between a first zone and a second zone of the borehole, comprising:

a tubular metal part for mounting as part of the well tubular metal structure, the downhole expandable metal tubular according to claim 1 or the downhole expandable metal tubular assembly according to claim 12 surrounding the tubular metal part and having an outer tubular face facing towards an inner face of the borehole or the casing, each end of the downhole expandable metal tubular or the downhole expandable metal tubular assembly being connected with the tubular metal part, and an expandable space between the downhole expandable metal tubular or the downhole expandable metal tubular assembly and the tubular metal part.

16. The downhole expandable metal tubular according to claim 1, wherein the cavity is closed in the radial direction.

17. The downhole expandable metal tubular according to claim 1, wherein an entirely of the cavity is formed exclusively by a portion of the outer face and the at least one first integral circumferential sealing element.

* * * * *